US009361866B2

(12) United States Patent
Mori

(10) Patent No.: US 9,361,866 B2
(45) Date of Patent: Jun. 7, 2016

(54) DRUM STAND

(71) Applicant: ROLAND CORPORATION, Shizuoka (JP)

(72) Inventor: Yoshiaki Mori, Shizuoka (JP)

(73) Assignee: ROLAND CORPORATION, Shizuoka (JP)

( * ) Notice: Subject to any disclaimer, the term of this patent is extended or adjusted under 35 U.S.C. 154(b) by 7 days.

(21) Appl. No.: 14/691,560

(22) Filed: Apr. 20, 2015

(65) Prior Publication Data

US 2016/0005386 A1 Jan. 7, 2016

(30) Foreign Application Priority Data

Jul. 1, 2014 (JP) ..... 2014-136208

(51) Int. Cl.
*G10D 13/02* (2006.01)

(52) U.S. Cl.
CPC ..... *G10D 13/026* (2013.01)

(58) Field of Classification Search
CPC ..... G10D 13/02; G10D 13/026; G10D 13/00; G10G 5/005; G10G 5/00
USPC ..... 84/411 R, 421
See application file for complete search history.

(56) References Cited

U.S. PATENT DOCUMENTS 7,612,274 B2 11/2009 Nakata
7,732,692 B2 6/2010 Mori et al.
8,367,919 B2 2/2013 Belitz et al.
8,664,500 B2 * 3/2014 Shimada ..... F16M 11/245 248/170
2008/0229902 A1 9/2008 Mori et al.
2008/0276788 A1 11/2008 Nakata

FOREIGN PATENT DOCUMENTS

JP H05-016632 4/1993
JP 2008-233523 10/2008
JP 2008-281592 11/2008

OTHER PUBLICATIONS

Drum Workshop Inc., http:www.dwdrums.com/smartpractice/specialty.asp, retrieved on Aug. 9, 2012, "Go Anywhere 5-Piece Practice Set(DWCPPADTS5)".
The Music People Inc., http:onstagestands.com/products/view/ks7350, retrieved on Mar. 20, 2014, "On-Stage Stands KS7350/KS7365EJ".
Ultimate Support Systems Inc http:ultimatesupport.com/product/AX-48Pro, retrieved on Mar. 20, 2014, "Ultimate AX-48 Pro".

* cited by examiner

*Primary Examiner* — Kimberly Lockett
(74) *Attorney, Agent, or Firm* — Jianq Chyun IP Office

(57) ABSTRACT

Provided is a drum stand that includes a first pipe holding a percussion instrument, a second pipe to which the first pipe is connected, and a leg member supporting the second pipe on a floor surface. The first pipe is slidable along an axial direction of the second pipe. A lower end of the second pipe is in contact with the floor surface. The leg member is in contact with the floor surface on one side in a horizontal direction relative to the lower end of the second pipe and supports the second pipe in a state that an upper end of the second pipe is on the one side in the horizontal direction relative to the lower end of the second pipe.

20 Claims, 6 Drawing Sheets

DRUM STAND

CROSS-REFERENCE TO RELATED APPLICATIONS

This application claims the priority benefit of Japan application serial no. 2014-136208, filed on Jul. 1, 2014. The entirety of the above-mentioned patent application is hereby incorporated by reference herein and made a part of this specification.

BACKGROUND OF THE INVENTION

1. Field of the Invention

The present invention relates to a drum stand. Particularly, the present invention relates to a drum stand for efficiently adjusting the positions of multiple percussion instruments.

2. Description of Related Art

A drum stand is known for holding multiple percussion instruments. The drum stand is configured to hold the percussion instruments in a state that the struck heads are tilted relative to the horizontal direction in a direction to be struck by the player easily.

As an example of such a drum stand, Japanese Patent Publication No. 2008-233523 discloses a drum stand, in which an arm pipe (first pipe) that extends in the horizontal direction is connected to a center pipe (second pipe) set vertically relative to the floor surface.

The player moves the percussion instruments to suit the height of the player and the lengths of the player's arms and legs, so as to place the percussion instruments in proper positions to facilitate the playing. Meanwhile, the player adjusts the positions of the percussion instruments by moving these percussion instruments in the vertical direction and the front-back direction (near side or far side from the player's viewpoint).

However, the conventional drum stand, as described above, has the problem that two processes are required for moving the percussion instruments to proper positions, which makes adjustment of the positions of the percussion instruments complicated. One of the two processes is to slide the arm pipe along the axial direction of the center pipe to adjust the positions of the percussion instruments in the vertical direction. The other one of the two processes is to axially rotate the arm pipe around the center pipe to adjust the positions of the percussion instruments in the front-back direction.

SUMMARY OF THE INVENTION

In view of the above, the present invention provides a drum stand for efficiently adjusting the positions of multiple percussion instruments.

According to the drum stand of a technical solution of the present invention, a leg member supports a second pipe in a state that an upper end of the second pipe is on one side in the horizontal direction relative to a lower end of the second pipe. In other words, the second pipe is supported by the leg member in a state that tilts relative to the floor surface.

Here, the player is on the other side in the horizontal direction of the drum stand. Thus, by sliding a first pipe along the axial direction of the second pipe, the player can simultaneously move the percussion instruments held by the first pipe toward the upper side and the far side (the one side in the horizontal direction) from the player's viewpoint. Alternatively, the player can simultaneously move the percussion instruments held by the first pipe toward the lower side and the near side (the other side in the horizontal direction) from the player's viewpoint.

That is, generally, a tall player has longer arms and legs, and a short player has shorter arms and legs. Therefore, when adjusting the positions of the percussion instruments, the player usually moves all the percussion instruments to the upper side and the far side, or to the lower side and the near side from the player's viewpoint.

Regarding this, with the drum stand of the technical solution of the present invention, the percussion instruments can be moved toward the upper side and the far side, or the lower side and the near side from the player's viewpoint, by one process of sliding the first pipe along the axial direction of the second pipe. Hence, the positions of multiple percussion instruments can be adjusted efficiently.

In addition, the second pipe is supported by the leg member with the lower end of the second pipe in contact with the floor surface. In other words, a lower portion of the second pipe and the leg member constitute the leg structure of the drum stand. By using the second pipe as a portion of the leg structure of the drum stand, as described above, the second pipe can be stably supported.

Moreover, the leg member is in contact with the floor surface on one side in the horizontal direction relative to the lower end of the second pipe and supports the second pipe from one direction side such that the second pipe tilts toward the one side in the horizontal direction. Thus, the leg member can stably support the second pipe.

According to the drum stand of another technical solution of the present invention, a mounting position of a first holder on the second pipe can be changed. Therefore, in addition to the aforementioned effects, the position of the first pipe can be adjusted. Besides, when a plurality of first pipes are held by the second pipe, the positions of the first pipes can be adjusted individually. Hence, fine adjustment of the configuration of the percussion instruments can be easily performed.

According to the drum stand of another technical solution of the present invention, the second pipe is extensible or retractable along the axial direction of the second pipe. Therefore, in addition to the aforementioned effects, the position of the first pipe can be adjusted. Besides, when a plurality of first pipes are held by the second pipe, the positions of the first pipes can be adjusted simultaneously. Hence, the configuration of the percussion instruments can be adjusted efficiently.

According to the drum stand of another technical solution of the present invention, a mounting position of the leg member on the second pipe can be changed by changing a mounting position of a second holder on the second pipe, so as to change a tilt angle of the second pipe relative to the floor surface. Therefore, in addition to the aforementioned effects, the position of the first pipe can be adjusted. Moreover, when a plurality of first pipes are held by the second pipe, the positions of the first pipes can be adjusted simultaneously. Hence, the configuration of the percussion instruments can be adjusted efficiently.

According to the drum stand of another technical solution of the present invention, a portion of a grounding part, which is in contact with the floor surface, has a spherical shape. Thus, in addition to the aforementioned effects, the grounding part can be properly in contact with the floor surface even if the mounting position of the leg member on the second pipe is changed, so as to improve the stability of the drum stand.

According to the drum stand of another technical solution of the present invention, the leg member has a T shape that includes a first leg part having an end connected with the second pipe and a second leg part connected with the other end of the first leg. Thus, in addition to the aforementioned effects, the structure of the leg member is simplified and the second pipe can still be supported stably.

According to the drum stand of another technical solution of the present invention, at least one of the first leg part and the second leg part has a curved shape such that the other end of the first leg part or both ends of the second leg part are close to the floor surface. Therefore, in addition to the aforementioned effects, the leg member can be made compact.

DESCRIPTION OF THE EMBODIMENTS

Figure 1:
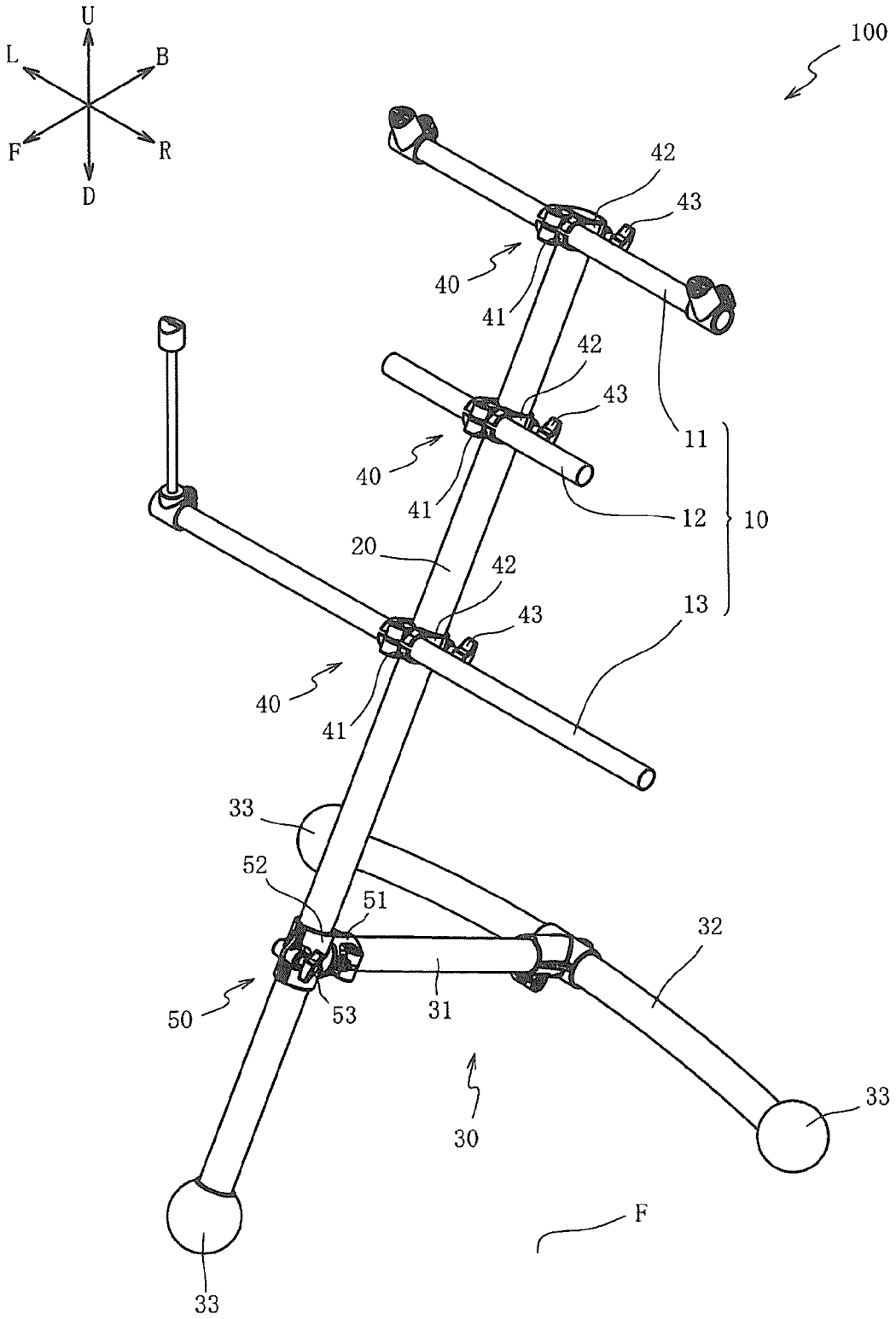
FIG. 1 is a perspective view of the drum stand according to the first embodiment.

Below exemplary embodiments of the present invention are described with reference to the affixed figures. First, a drum stand 100 according to the first embodiment of the present invention is described with reference to FIG. 1. FIG. 1 is a perspective view of the drum stand 100 according to the first embodiment.

The arrows U-D, L-R, and F-B in the figures respectively indicate the vertical direction, the left-right direction, and the front-back direction of the drum stand 100. In the figures, the near side from the player's viewpoint is referred to as the front of the drum stand 100 and the far side from the player's viewpoint is referred to as the back of the drum stand 100. In addition, the left-right direction of the drum stand 100 is referred to based on the direction viewed from the player.

The drum stand 100 mainly includes three holding pipes 10, a support pipe 20, and a leg member 30. The three holding pipes 10 hold percussion instruments. The support pipe 20 supports the three holding pipes 10. The leg member 30 supports the support pipe 20 in a state that tilts relative to a floor surface F.

The holding pipe 10 is made of a pipe-shaped member that extends in a straight line. Regarding the three holding pipes 10, an axial-direction length (the length in the L-R direction of FIG. 1) of an upper pipe 11 located in the uppermost position is longer than a middle pipe 12 located below the upper pipe 11. Moreover, the axial-direction length (the length in the L-R direction of FIG. 1) of the upper pipe 11 located in the uppermost position is shorter than a lower pipe 13 located below the middle pipe 12.

The support pipe 20 is made of a pipe-shaped member that extends in a straight line. The holding pipe 10 is connected to the support pipe 20 through a first holder 40.

The first holder 40 includes a first gripping part 41, a first fastening part 42, and a first bolt 43. The first gripping part 41 has a cylindrical shape. The first fastening part 42 has a substantially C-shaped cross section that is adjacent to the first gripping part 41. The first bolt 43 is inserted into holes, which are respectively formed on two ends of the first fastening part 42 in the circumferential direction, and connects the two ends of the first fastening part 42 in the circumferential direction.

The first gripping part 41 is a part that grips the holding pipe 10. The first fastening part 42 is a part that fastens and secures the support pipe 20. The first gripping part 41 and the first fastening part 42 are configured in a manner that the central axes of the first gripping part 41 and the first fastening part 42 are perpendicular to each other. In a state where the holding pipe 10 and the support pipe 20 are connected to the first holder 40, the holding pipe 10 extends perpendicularly to the support pipe 20.

The first holder 40 is configured such that the inner diameter of the first fastening part 42 is changed by adjusting a fastening amount of the first bolt 43. That is, by fastening the first bolt 43 to reduce the inner diameter of the first fastening part 42, the first fastening part 42 can be fixed to the support pipe 20. Further, by loosening the fastened first bolt 43 to increase the inner diameter of the first fastening part 42, the first fastening part 42 that fixes the support pipe 20 can be released.

Therefore, with the drum stand 100, the mounting position of the first holder 40 on the support pipe 20 (the mounting position of the first holder 40 in the axial direction of the support pipe 20) can be changed by releasing the first holder 40 that fixes the support pipe 20 and fixing the first holder 40 again. By changing the mounting position of the first holder 40, the mounting position of the holding pipe 10 on the support pipe 20 (the position in the axial direction of the support pipe 20, which connects the holding pipe 10) can be changed.

The leg member 30 mainly includes a first leg part 31 and a second leg part 32. An end of the first leg part 31 is connected with the support pipe 20. The second leg part 32 extends in a direction that intersects the first leg part 31. By connecting the other end portion of the first leg part 31 with an axial-direction center portion of the second leg part 32, the leg member 30 forms a substantially T shape. Therefore, the structure of the leg member 30 is simplified and the leg member 30 can support the support pipe 20 stably.

The first leg part 31 is made of a pipe-shaped member that extends in a straight line. The second leg part 32 is made of a pipe-shaped member that is curved.

Two axial-direction end portions of the second leg part 32 are respectively mounted with ball-shaped grounding parts 33. The grounding part 33 is made of an elastic body that has higher elasticity than the second leg part 32. The second leg part 32 is placed on the floor surface F through grounding parts 33.

The axial-direction center portion of the second leg part 32 is above the two end portions of the second leg part 32. The second leg part 32 is curved such that two ends thereof are closer to the floor surface F than the axial-direction center portion.

In comparison with forming the second leg part 32 in a straight shape, the curved second leg part 32 can shorten the axial-direction length of the first leg part 31. In addition, since the second leg part 32 is curved with two ends closer to the floor surface F, the height dimension and the size of the grounding part 33 can be reduced correspondingly. As a result, the entire leg member 30 can be made compact. In other words, the production costs of the leg member 30 can be reduced.

The leg member 30 is connected to the support pipe 20 through a second holder 50. The second holder 50 is located below the first holder 40.

The second holder 50 includes a second gripping part 51, a second fastening part 52, and a second bolt 53. The second gripping part 51 has a cylindrical shape. The second fastening part 52 is connected with the second gripping part 51 and has a substantially C-shaped cross section. The second bolt 53 is inserted into holes, which are respectively formed on two ends of the second fastening part 52 in the circumferential direction, and connects the two ends of the second fastening part 52 in the circumferential direction.

The second gripping part 51 is a part that grips the first leg part 31. The second fastening part 52 is a part that fastens and secures the support pipe 20. The second gripping part 51 and the second fastening part 52 are configured in a manner that the central axes of the second gripping part 51 and the second fastening part 52 are perpendicular to each other. One end side of the second gripping part 51 in the axial direction is connected with an outer circumferential surface of the second fastening part 52. Thus, in a state where the leg member 30 and the support pipe 20 are connected to the second holder 50, the first leg part 31 extends perpendicularly to the support pipe 20.

The second holder 50 is configured such that the inner diameter of the second fastening part 52 is changed by adjusting a fastening amount of the second bolt 53. That is, by fastening the second bolt 53 to reduce the inner diameter of the second fastening part 52, the second fastening part 52 can be fixed to the support pipe 20. Further, by loosening the fastened second bolt 53 to increase the inner diameter of the second fastening part 52, the second fastening part 52 that fixes the support pipe 20 can be released.

Therefore, with the drum stand 100, the mounting position of the second holder 50 on the support pipe 20 (the mounting position of the second holder 50 in the axial direction of the support pipe 20) can be changed by releasing the second holder 50 that fixes the support pipe 20 and fixing the second holder 50 again. By changing the mounting position of the second holder 50, the mounting position of the leg member 30 on the support pipe 20 (the position in the axial direction of the support pipe 20, which connects the leg member 30) can be changed.

Here, the grounding part 33 is also disposed on a lower end of the support pipe 20. In other words, the drum stand 100 is configured such that the three grounding parts 33 are mounted on the support pipe 20 and two ends of the second leg part 32 to be in contact with the floor surface F.

That is, the support pipe 20 is supported by the leg member 30 with the lower end of the support pipe 20 in contact with the floor surface F. In other words, a lower portion of the support pipe 20 (the portion below where the second holder 50 is fixed) and the leg member 30 constitute the leg structure of the drum stand 100. By using the support pipe 20 as a portion of the leg structure of the drum stand 100, as described above, the support pipe 20 can be stably supported. Furthermore, the costs of parts of the drum stand 100 can be reduced.

The support pipe 20 is supported by the leg member 30 in a state that the central axis of the support pipe 20 tilts relative to the floor surface F with the upper end behind the lower end. Regarding the leg member 30, the first leg part 31 extends backward from the support pipe 20, and the grounding parts 33 are in contact with the floor surface F behind the lower end of the support pipe 20. In this way, the leg member 30 supports the support pipe 20 that tilts backward from the back side. Thus, the support pipe 20 can be stably supported.

Figure 2:
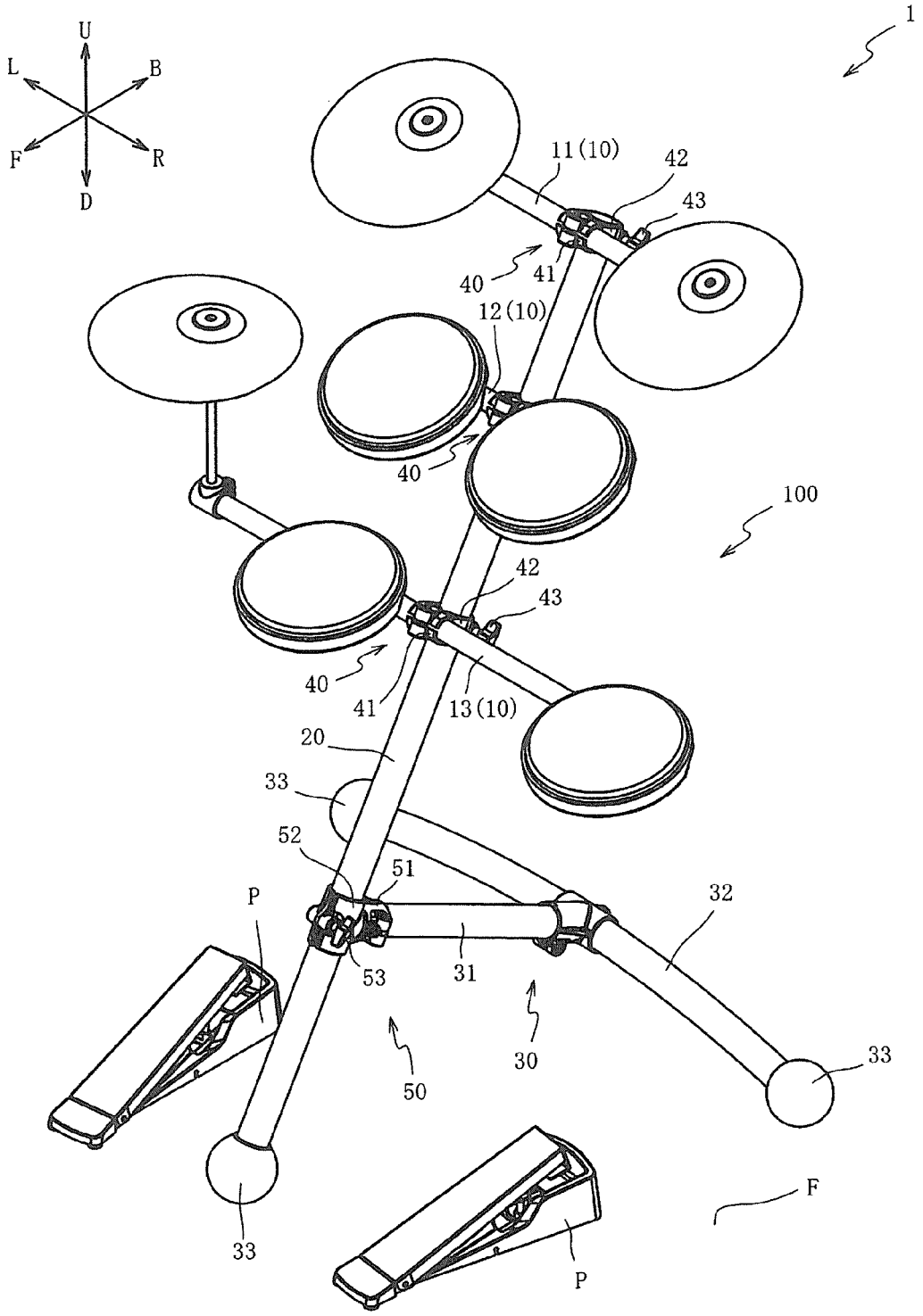
FIG. 2 is a perspective view of the drum set.
Figures 3A, 3B, 3C:
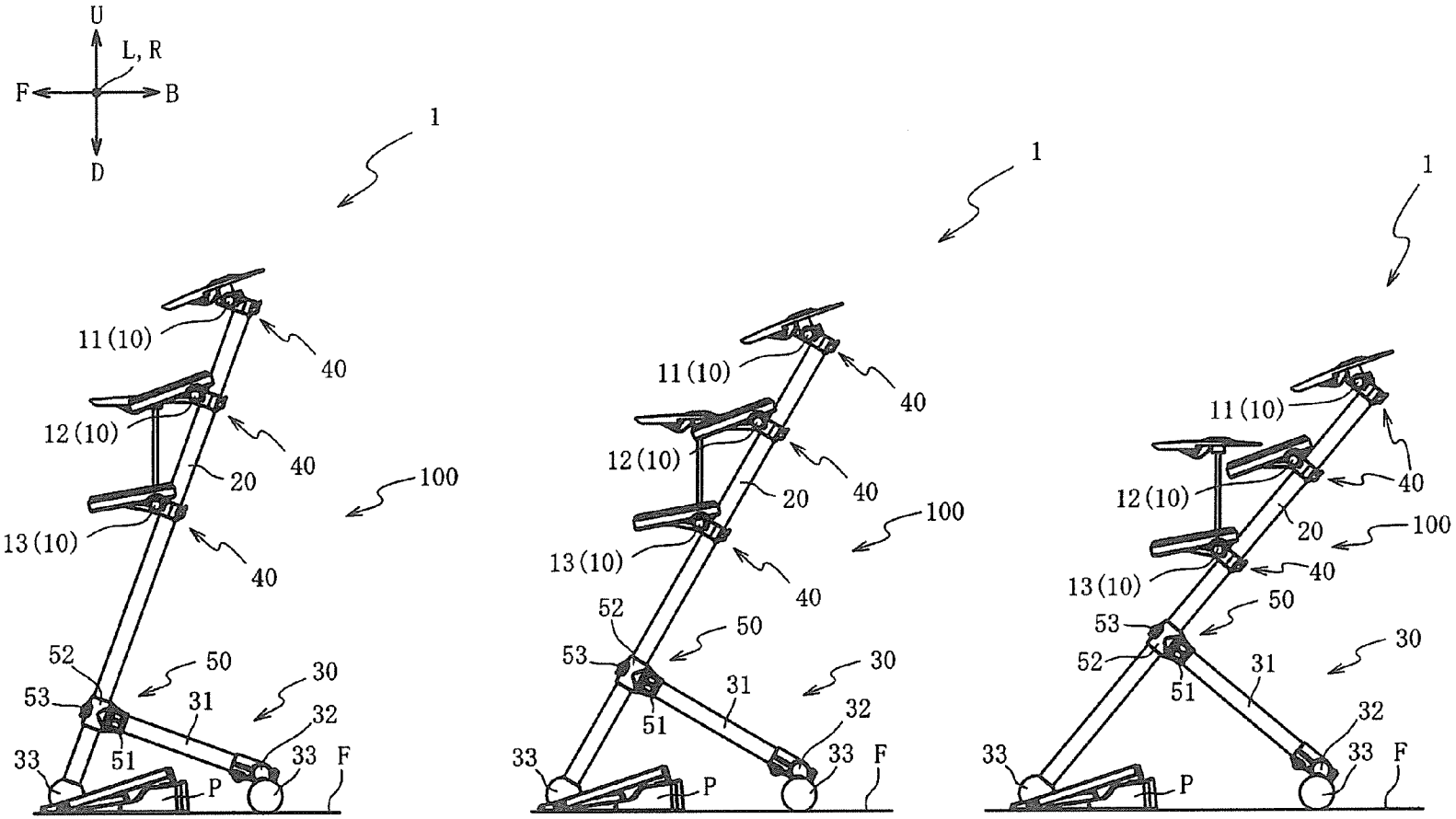
FIG. 3A to FIG. 3C are side views of the drum set.

Next, a state of use of the drum stand 100 is described with reference to FIG. 2 and FIG. 3A to FIG. 3C. FIG. 2 is a perspective view of a drum set 1. FIG. 2 illustrates a state where a plurality of electronic percussion instruments are held by the drum stand 100. FIG. 3A to FIG. 3C are side views of the drum set 1. The support pipe 20 of the drum set 1, as shown in FIG. 3B, has a smaller tilt angle relative to the floor surface F than the support pipe 20 of the drum set 1, as shown in FIG. 3A. Besides, the support pipe 20 of the drum set 1, as shown in FIG. 3B, has a larger tilt angle relative to the floor surface F than the support pipe 20 of the drum set 1, as shown in FIG. 3C.

In the drum set 1, as shown in FIG. 2, electronic percussion instruments that simulate cymbal, snare drum, tam-tam, etc. are held by the holding pipes 10. Moreover, pedal devices P respectively configured as an electronic percussion instrument to be played along with a stepping operation of the player are provided on the floor surface F.

In the drum set 1, the holding pipes 10 are connected to the support pipe 20. The upper end of the support pipe 20 is located behind the lower end of the support pipe 20. Therefore, the lower pipe 13 is at the front and the upper pipe 11 is at the back.

One holding pipe 10 holds multiple electronic percussion instruments. The positions of these electronic percussion instruments can be adjusted by changing the mounting position of the first holder 40 relative to the support pipe 20.

Generally, if the player who intends to adjust the positions of the percussion instruments is taller than the previous player, the player may have longer arms and legs; and if the player is shorter than the previous player, the player may have shorter arms and legs.

Thus, it is assumed that, in most cases, when moving the percussion instruments to proper positions to facilitate the playing, the player adjusts the positions of the percussion instruments to the upper side and the far side, or the lower side and the near side, from the player's viewpoint according to the lengths of the player's arms and legs.

Regarding this, the drum set 1 is configured in a manner that the support pipe 20 tilts relative to the floor surface F with the upper end of the support pipe 20 behind the lower end. Therefore, by moving the first holder 40 along the axial direction of the support pipe 20, the height positions of the percussion instruments held by the holding pipe 10 from the floor surface and the positions of the percussion instruments in the front-back direction can be adjusted simultaneously.

That is to say, when the first holder 40 is moved upward, the holding pipe 10 can be moved toward the upper side and the back (the far side from the player's viewpoint). Further, when the first holder 40 is moved downward, the holding pipe 10 can be moved toward the lower side and the front (the near side from the player's viewpoint). Hence, the positions of multiple percussion instruments can be adjusted efficiently.

Meanwhile, the percussion instruments held by the holding pipe 10 slide and move along the axial direction of the support pipe 20. Thus, it is possible to prevent the struck heads of the percussion instruments from turning to the left side or the right side from the player's viewpoint.

That is, upon adjustment of the front-back positions of the percussion instruments held by the holding pipe 10, when the holding pipe 10 is rotated around the support pipe 20, the percussion instruments also rotate and move around the support pipe 20, and the struck heads of the percussion instruments are turned to the left side or the right side from the player's viewpoint. In that case, the stick swung down in the vertical direction to hit the struck head may bounce to the left side or the right side, to which the struck head is turned. For this reason, it is difficult to make continuous hits on the struck head, for example.

Regarding this, the drum stand 100 can prevent the struck head from turning to the left side or the right side from the player's viewpoint. Therefore, the aforementioned problem that results from the adjustment of the positions of the percussion instruments and hinders the playing of the percussion instruments can be solved.

In the drum stand 100, the axial-direction center portion of the holding pipe 10 is connected to the support pipe 20 through the first holder 40. In addition, the percussion instruments are held by one holding pipe 10 on both the left side and the right side of the support pipe 20.

Here, where one holding pipe 10 is rotated around the support pipe 20 as the percussion instruments held by the holding pipe 10 are moved forward or backward, corresponding to the forward movement of the percussion instrument held by the holding pipe 10 on one side of the support pipe 20 in the left-right direction, the percussion instrument held by the holding pipe 10 on the other side of the support pipe 20 in the left-right direction moves backward. In other words, the percussion instruments held by one holding pipe 10 respectively on one side and the other side of the support pipe 20 in the left-right direction cannot be both moved forward or backward.

Thus, for the conventional drum stand that adjusts the front-back positions of the percussion instruments by rotating the holding pipe around the support pipe, it is necessary to dispose separate holding pipes that respectively extend from the support pipe to one side and the other side in the left-right direction.

In contrast thereto, with the drum stand 100, the percussion instruments held by one holding pipe 10 respectively on one side and the other side of the support pipe 20 in the left-right direction can both be moved forward or backward by sliding and moving the holding pipe 10 along the axial direction of the support pipe 20.

As described above, the drum stand 100 allows one holding pipe 10 to extend to both the left side and the right side from the support pipe 20 and hold the percussion instruments on both the left side and the right side of the one holding pipe 10. Thus, in comparison with the conventional drum stand, the costs of parts of the drum stand 100 can be reduced.

Furthermore, because one holding pipe 10 is gripped by one first holder 40, the position of any one of the three holding pipes 10 can be adjusted individually. Hence, fine adjustment of electronic percussion instruments can be easily performed.

The leg member 30 of the drum stand 100 is in contact with the floor surface F behind the lower end of the support pipe 20. Therefore, the space on the front side (the near side from the player's viewpoint) can be widened for disposing the pedal device P on the floor surface F to facilitate the playing. In addition, it is possible to prevent the leg member 30 from limiting the configuration of the pedal device P.

Referring to the drum stand 100, as shown in FIG. 3A to FIG. 3C, the mounting position of the leg member 30 relative to the support pipe 20 can be changed by changing the mounting position of the second holder 50 on the support pipe 20. Therefore, by changing the tilt angle of the support pipe 20 relative to the floor surface F, the position of the holding pipe 10 can be adjusted.

That is, by moving the mounting position of the second holder 50 toward the upper end side of the support pipe 20 to reduce the tilt angle of the support pipe 20 relative to the floor surface F, the intervals between the three holding pipes 10 in the front-back direction can be increased. On the other hand, by moving the mounting position of the second holder 50 toward the lower end side of the support pipe 20 to increase the tilt angle of the support pipe 20 relative to the floor surface F, the intervals between the three holding pipes 10 in the front-back direction can be decreased.

In order to stabilize the drum stand 100, it is preferable to set the tilt angle of the support pipe 20 relative to the floor surface F in a range of 55 to 75 degrees. Moreover, the mounting position of the second holder 50 may be restricted in order to keep the tilt angle of the support pipe 20 relative to the floor surface F in the aforementioned range. Alternatively, a mark for confirming the aforementioned range may be disposed on the support pipe 20.

Besides, the positions of the three holding pipes 10 can be adjusted simultaneously by changing the mounting position of the second holder 50 relative to the support pipe 20, and therefore the configuration of the percussion instruments can be adjusted efficiently.

Further, the grounding part 33 of the drum stand 100 has a ball shape, and a portion of the grounding part 33 that is in contact with the floor surface F has a spherical shape. Thus, even if the mounting position of the leg member 30 relative to the support pipe 20 is changed, the grounding part 33 can still be properly placed in contact with the floor surface F. In other words, the stability of the drum stand 100 can be improved.

Next, the second embodiment is described with reference to FIG. 4 to FIGS. 6A-6B. The first embodiment illustrates a situation where the position of the holding pipe 10 is adjusted by changing the mounting position of the first holder 40 or the second holder 50 relative to the support pipe 20. In the second embodiment, the position of a holding pipe 210 is adjusted by extending/retracting a support pipe 220. The same reference numerals are assigned to denote parts the same as the above embodiment. Thus, detailed descriptions thereof are omitted hereinafter.

Figure 4:
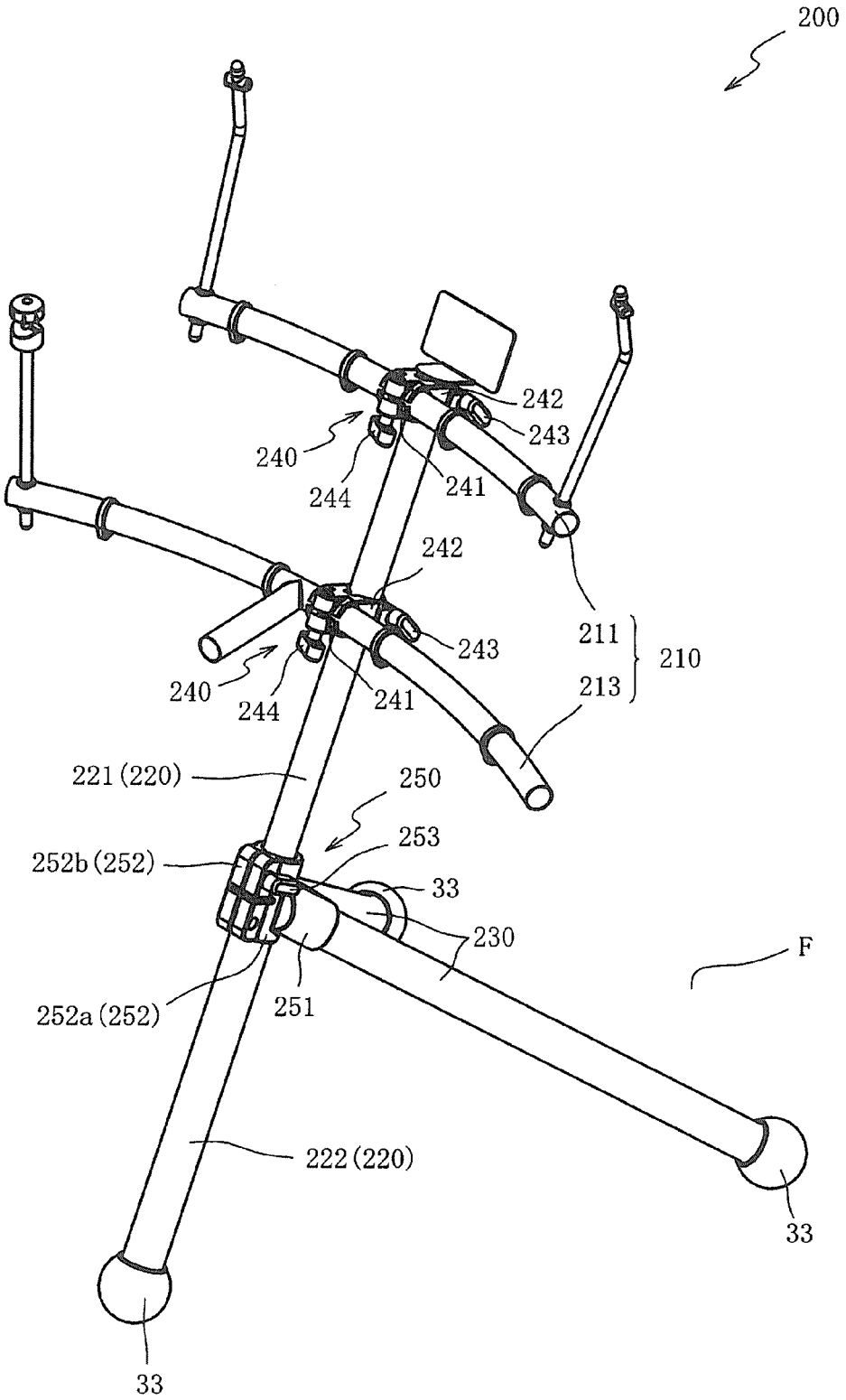
FIG. 4 is a perspective view of the drum stand according to the second embodiment.
Figure 5B:
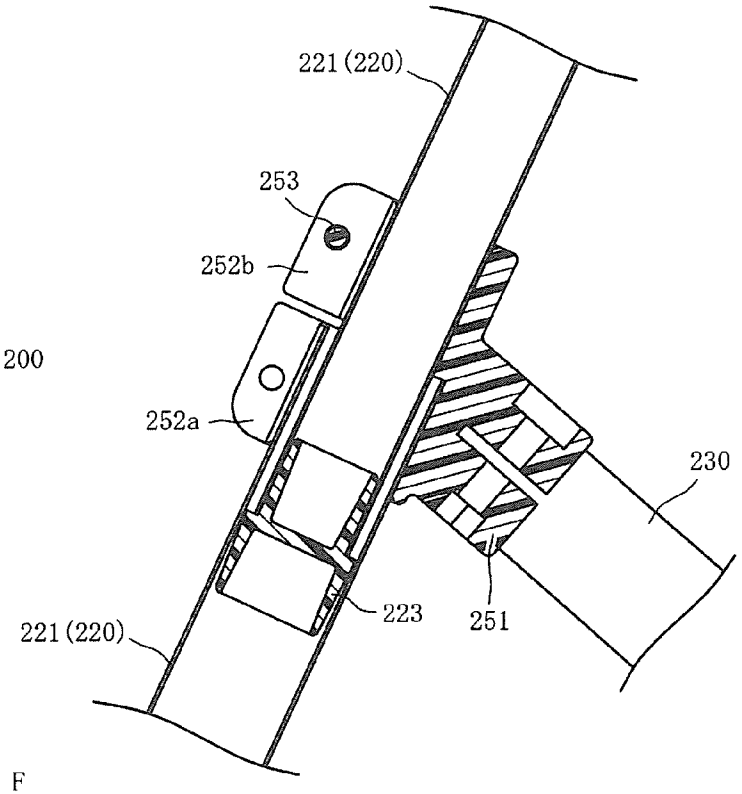
FIG. 5B is a partially enlarged cross-sectional view of the Vb section of the drum stand of FIG. 5A.
Figure 5A:
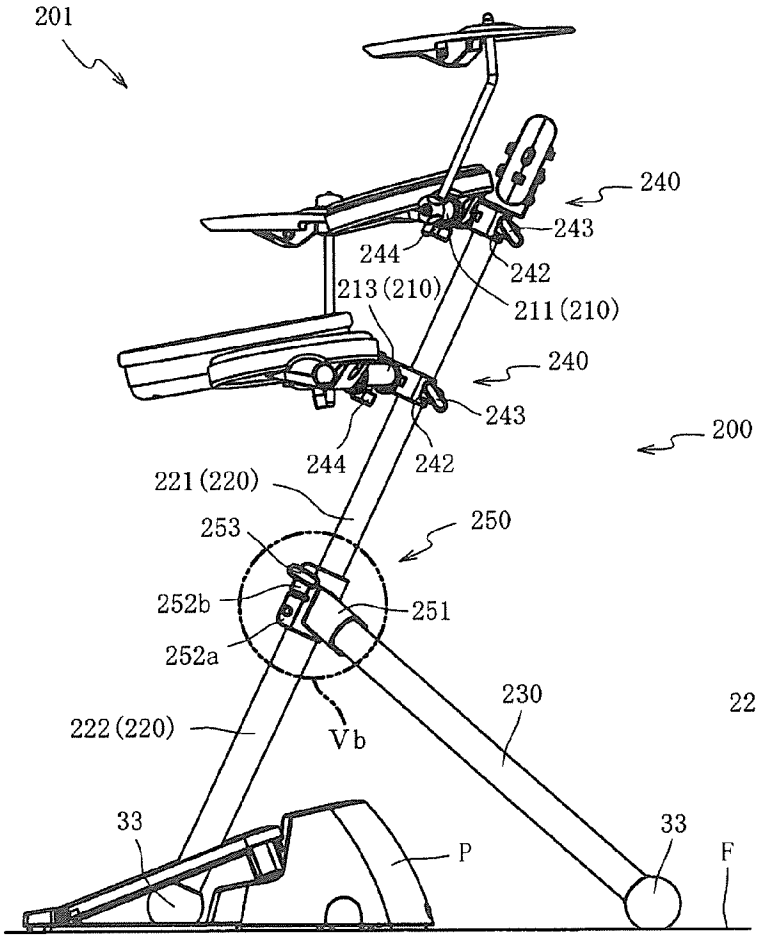
FIG. 5A is a side view of the drum stand.

First, a drum stand 200 of the second embodiment is described with reference to FIG. 4, FIG. 5A, and FIG. 5B. FIG. 4 is a perspective view of the drum stand 200 according to the second embodiment. FIG. 5A is a side view of the drum stand 200. FIG. 5B is a partially enlarged cross-sectional view of the Vb section of the drum stand 200 of FIG. 5A.

As shown in FIG. 4 and FIG. 5A, the drum stand 200 mainly includes two holding pipes 210, the support pipe 220, and two leg members 230. The support pipe 220 supports the two holding pipes 210. The two leg members 230 support the support pipe 220 in a state that tilts relative to the floor surface F.

The holding pipe 210 is made of a pipe-shaped member that is curved. Regarding the two holding pipes 210, an axial-direction length of an upper pipe 211 located in the upper position is shorter than an axial-direction length of a lower pipe 213 located below the upper pipe 211.

The support pipe 220 is made of two pipe-shaped members that extend in a straight line. Regarding the support pipe 220, the outer diameter of an upper pipe 221 located on the upper side is smaller than the inner diameter of a lower pipe 222 located on the lower side. A lower portion of the upper pipe 221 is configured to be housed in the lower pipe 222.

By relatively displacing the upper pipe 221 relative to the lower pipe 222 along the axial direction of the support pipe 220, the axial-direction length of the support pipe 220 can be adjusted. In other words, the support pipe 220 is extensible/retractable.

In addition, a sleeve 223 that can be fitted into the lower pipe 222 is connected to a lower end of the upper pipe 221. By fitting the sleeve 223 into the lower pipe 222, it is possible to prevent the upper pipe 221 from falling. The sleeve 223 can also suppress damage of the upper pipe 221 and the lower pipe 222, which is caused by sliding the upper pipe 221 relative to the lower pipe 222.

Further, the holding pipe 210 is connected to the support pipe 220 through a first holder 240. The first holder 240 includes a first gripping part 241, a first fastening part 242, a first bolt 243, and a third bolt 244. The first gripping part 241 has a substantially C-shaped cross section. The first fastening part 242 is adjacent to the first gripping part 241. The third bolt 244 is inserted into holes, which are respectively formed on two ends of the first gripping part 241 in the circumferential direction, and connects two ends of the first gripping part 241 in the circumferential direction.

The first holder 240 is configured such that the inner diameter of the first gripping part 241 is changed by adjusting a fastening amount of the third bolt 244. That is, by fastening the third bolt 244 to reduce the inner diameter of the first gripping part 241, the holding pipe 210 can be fixed to the first gripping part 241. Further, by loosening the fastened third bolt 244 to increase the inner diameter of the first gripping part 241, the first gripping part 241 that fixes the holding pipe 210 can be released.

Thus, with the drum stand 200, the mounting position of the first holder 240 on the holding pipe 210 (the mounting position of the first holder 240 in a direction perpendicular to the axial direction of the support pipe 220) can be changed by releasing and fixing again the first holder 240 with respect to the holding pipe 210. The mounting position of the holding pipe 210 on the support pipe 220 (the position that the holding pipe 210 is connected to the support pipe 220 in the central axial direction of the holding pipe 210) can be changed by changing the mounting position of the first holder 240.

In addition, with the drum stand 200, the holding pipe 210 can be axially rotated around the central axis of the first gripping part 241 by releasing the first holder 240 that fixes the holding pipe 210 and fixing the first holder 240 again. Through the axial rotation of the holding pipe 210, the configuration of the percussion instruments held by the holding pipe 210 can be adjusted.

The leg member 230 is made of a pipe-shaped member that extends in a straight line. An end of the leg member 230 is connected to the support pipe 220 through a second holder 250, which is described later. A grounding part 33 is disposed on the other end of the leg member 230.

The grounding part 33 is also disposed on the lower end of the lower pipe 222. The drum stand 200 is configured such that the three grounding parts 33 disposed on the lower end of the lower pipe 222 and the other ends of the two leg members 230 can be in contact with the floor surface F.

The support pipe 220 is supported by the leg members 230 with the lower end of the support pipe 220 in contact with the floor surface F. In other words, the lower pipe 222 and the two leg members 230 serve as three legs for supporting the upper pipe 221.

By using the lower pipe 222 as a portion of the leg structure of the drum stand 200, as described above, the support pipe 220 can be stably supported. Furthermore, the costs of parts of the drum stand 200 can be reduced.

The second holder 250 mainly includes two second gripping parts 251 and a second fastening part 252. The two second gripping parts 251 respectively have a cylindrical shape. The second fastening part 252 is adjacent to the two second gripping parts 251.

Each of the two second gripping parts 251 is a part that holds one end of the leg member 230. The axial directions of the two second gripping parts 251 are respectively oriented to different directions.

The second fastening part 252 includes a lower fixing part 252*a*, an upper fixing part 252*b*, and a second bolt 253. The lower fixing part 252*a* has a cylindrical shape. The upper fixing part 252*b* has a substantially C-shaped cross section that is positioned coaxially with the lower fixing part 252*a*. The second bolt 253 is inserted into holes, which are respectively formed on two ends of the upper fixing part 252*b* in the circumferential direction, and connects two ends of the second fastening part 252 in the circumferential direction.

The lower fixing part 252*a* is a part that grips the upper end of the lower pipe 222. The upper fixing part 252*b* is a part that fastens and fixes the upper pipe 221. The inner diameter of the upper fixing part 252*b* can be changed by adjusting a fastening amount of the second bolt 253.

That is, by tightly fastening the second bolt 253 to reduce the inner diameter of the upper fixing part 252*b*, the upper pipe 221 is fixed to the upper fixing part 252*b*. Therefore, by restricting the relative displacement of the upper pipe 221 with respect to the lower pipe 222, extension/retraction of the support pipe 220 during use of the drum stand 200 can be prevented.

In addition, by loosening the fastened second bolt 253 to increase the inner diameter of the upper fixing part 252*b*, the upper pipe 221 fixed by the upper fixing part 252*b* is released. Thereby, the upper pipe 221 is allowed to displace relative to the lower pipe 222 to extend/retract the support pipe 220.

As described above, with the drum stand 200, the axial-direction length of the support pipe 220 can be adjusted by releasing the second holder 250 that fixes the upper pipe 221 and fixing the second holder 250 again.

Figure 6B:
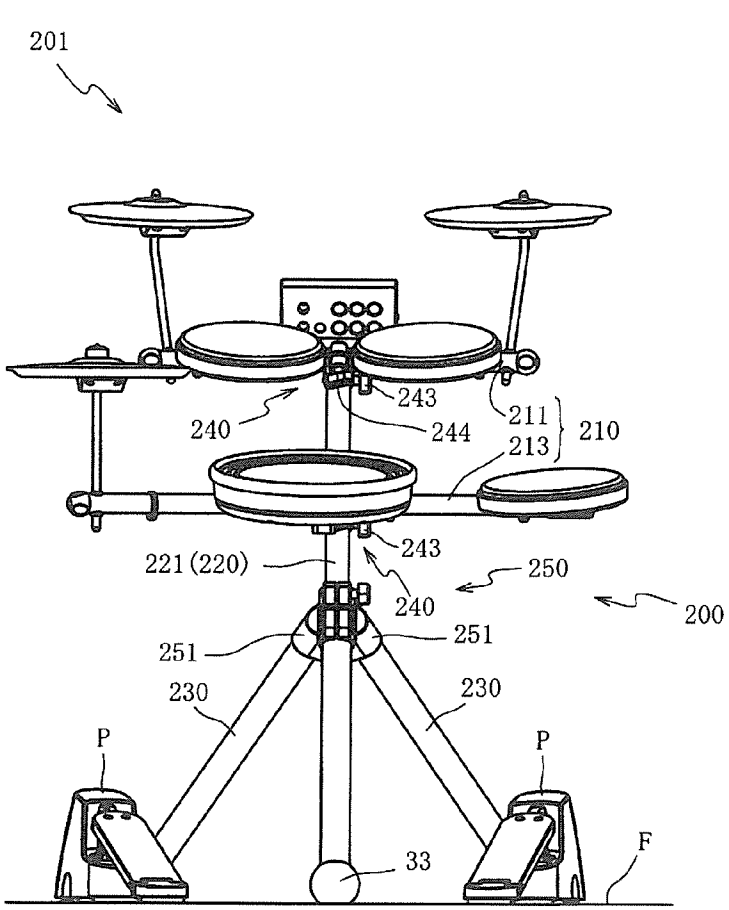
FIG. 6A and FIG. 6B are front views of the drum set.
Figure 6A:
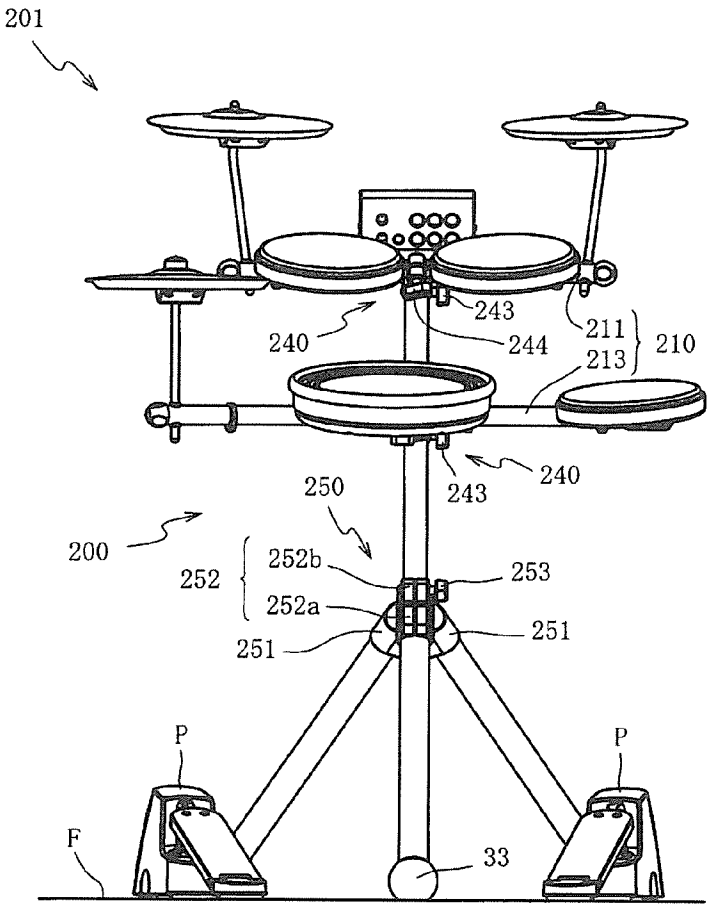

Next, a state of use of the drum stand 200 is described with reference to FIG. 6A and FIG. 6B. FIG. 6A and FIG. 6B are front views of a drum set 201. FIG. 6A and FIG. 6B illustrate a state where a plurality of electronic percussion instruments are held by the drum stand 200. The axial-direction length of the support pipe 220 in FIG. 6B is shorter than the axial-direction length of the support pipe 220 in FIG. 6A.

In the drum stand 200, as shown in FIG. 6A and FIG. 6B, two holding pipes 210 are connected to the support pipe 220 through the first holders 240.

The support pipe 220 is configured to tilt relative to the floor surface F with the upper end of the support pipe 220 (the upper end of the upper pipe 221) behind the lower end of the support pipe 220 (the lower end of the lower pipe 222). By extending/retracting the support pipe 220, the height positions and the front-back positions of the holding pipes 210 and the percussion instruments can be changed.

That is to say, when the support pipe 220 is extended by moving the upper pipe 221 toward the upper end side of the upper pipe 221 relative to the lower pipe 222, the holding pipe 210 connected with the upper pipe 221 slides and moves toward the upper side and the back side (the far side from the player's viewpoint). On the other hand, when the support pipe 220 is retracted by moving the upper pipe 221 toward the lower end side of the upper pipe 221 relative to the lower pipe 222, the holding pipe 210 connected with the upper pipe 221 slides and moves toward the lower side and the front side (the near side from the player's viewpoint).

As described above, the drum set 201 is configured such that the support pipe 220 tilts relative to the floor surface F with the upper end of the support pipe 220 behind the lower end thereof. Thus, by extending or retracting the support pipe 220, the height positions of the percussion instruments held by the holding pipe 210 from the floor surface can be adjusted, and the positions of the percussion instruments in the front-back direction can also be adjusted simultaneously.

That is, when the support pipe 220 is extended, the holding pipe 210 can be moved toward the upper side and the back side (the far side from the player's viewpoint). When the support pipe 220 is retracted, the holding pipe 210 can be moved toward the lower side and the front side (the near side from the player's viewpoint). Hence, the positions of multiple percussion instruments held by the holding pipe 210 can be adjusted efficiently.

Meanwhile, the percussion instruments held by the holding pipe 210 slide and move along the axial direction of the support pipe 220. Thus, it is possible to prevent the struck heads of the percussion instruments from turning to the left side or the right side from the player's viewpoint. In other words, the problem that results from the adjustment of the positions of the percussion instruments and hinders the playing of the percussion instruments can be avoided.

Besides, in the drum stand 200, the two holding pipes 210 are connected to the upper pipe 221. By moving the upper pipe 221 relative to the lower pipe 222, the positions of the two holding pipes 210 can be adjusted simultaneously without changing the relative positional relationship between the two holding pipes 210. Hence, the configuration of the percussion instruments can be adjusted efficiently.

Furthermore, in the drum stand 200, the leg members 230 extend backward from the support pipe 220, and the grounding parts 33 are in contact with the floor surface F behind the lower end of the lower pipe 222. Therefore, on the front side where the player is, the space can be widened for disposing the pedal device P on the floor surface F.

In the drum stand 200, the holding pipe 210 is connected to the upper pipe 221 through the first holder 240, and by operating the second holder 50 located below the first holder 240, the axial-direction length of the support pipe 220 can be adjusted. Thus, the support pipe 220 can be extended or retracted easily even if the player is short.

The above illustrates the present invention on the basis of the embodiments. Nevertheless, the present invention is not limited to any of the above embodiments. It can be easily inferred that various improvements or modifications may be made without departing from the spirit of the present invention.

For instance, the number or the shape, axial-direction length, etc. of the aforementioned holding pipes 10, 210 are merely examples. Certainly, it is possible to change the number or the axial-direction length of the holding pipes 10, 210. In addition, any type or any number of percussion instruments may be disposed on each holding pipe 10, 210. A rod may or may not be provided for holding the percussion instrument, and any holding method may be used for holding the percussion instruments on the holding pipe 10, 210.

The configuration described in any of the embodiments may be replaced with a configuration described in other embodiments. In addition, a configuration of other embodiments may be combined with or added to the configuration described in any of the embodiments. For example, the straight holding pipe 10 described in the first embodiment may be replaced with the curved holding pipe 210 described in the second embodiment. Moreover, the support pipe 20 described in the first embodiment may be replaced with the extensible/retractable support pipe 220 described in the second embodiment.

The above embodiments illustrate a situation where electronic percussion instruments are held on the drum stand 100, 200. However, the present invention is not limited thereto. It is certainly possible to hold acoustic percussion instruments or percussion instruments for practice purpose on the drum stand 100, 200.

The above embodiments illustrate a situation where the holding pipe 10, 210 is connected to the support pipe 20, 220 through the first holder 40, 240. However, the present invention is not limited thereto. The holding pipe 10, 210 may be fixed to the support pipe 20, 220 by welding, etc. In this way, the first holder 40, 240 is not required, and the costs of the parts can be reduced.

Likewise, the first embodiment illustrates a situation where the leg member 30 is connected to the support pipe 20 through the second holder 50. However, the present invention is not limited thereto. The leg member 30 may be fixed to the support pipe 20 by welding, etc. In this way, the second holder 50 is not required, and the costs of the parts can be reduced.

The above embodiments illustrate a situation where the grounding part 33 has a ball shape. However, the present invention is not limited thereto. The grounding part 33 may also have other shapes. Regarding the other shapes of the grounding part 33, the portion in contact with the floor surface F may have a hemispherical shape which is partially spherical, or the portion in contact with the floor surface F may have a flat surface, etc., for example.

The above embodiments illustrate a situation where the axial-direction center portion of the holding pipe 10, 210 is connected to the support pipe 20, 220, and the holding pipe 10, 210 extends toward both sides of the support pipe 20, 220 in the left-right direction from the player's viewpoint. However, the present invention is not limited thereto. It is possible to separately dispose two holding pipes that respectively extend toward the left side and the right side of the support pipe 20, 220 from the player's viewpoint by connecting the axial-direction end portions of the holding pipes to the support pipe 20, 220.

The first embodiment illustrates a situation where the leg member 30 is composed of two pipe members that are connected to form a substantially T shape. In addition, the second embodiment illustrates a situation where the leg member 230 is composed of two pipe members that respectively extend in a straight line. However, the present invention is not limited thereto. The leg member 30 may be in other forms. Regarding the other forms, the leg member 230 may include two or more rod-shaped members that are formed straight or curved, for example.

In addition, an anti-slip process may be applied on the portion of the grounding part 33 that is in contact with the floor surface F. The anti-slip process may be to form a protrusion on the portion that is in contact with the floor surface F, for example.

The first embodiment illustrates a situation where the central axis of the second gripping part 51 and the central axis of the second fastening part 52 are configured to be perpendicular to each other. However, the present invention is not limited thereto. The central axis of the second gripping part 51 and the central axis of the second fastening part 52 may not be perpendicular to each other. In addition, the angle between the central axis of the second gripping part 51 and the central axis of the second fastening part 52 may be changeable.

The first embodiment illustrates a situation where the first leg part 31 is straight while the second leg part 32 is curved. However, the present invention is not limited thereto. It is possible that the first leg part 31 is curved while the second leg part 32 is straight. Moreover, the first leg part 31 and the second leg part 32 may both be straight. The first leg part 31 and the second leg part 32 may both be curved.

The above embodiments illustrate a situation where the second holder 50 is connected to the support pipe 20 at a position lower than the first holder 40. However, the present invention is not limited thereto. The second holder 50 may be connected to the support pipe 20 at a position between the first holders 40 or above the first holder 40.

The second embodiment illustrates a situation where the outer diameter of the upper pipe 221 is smaller than the inner diameter of the lower pipe 222, and the lower portion of the upper pipe 221 is housed in the lower pipe 222. However, the present invention is not limited thereto. The outer diameter of the lower pipe 222 may be smaller than the inner diameter of the upper pipe 221, so as to house the upper portion of the lower pipe 222 in the upper pipe 221. In that case, when the support pipe 220 is extended or retracted, the axial-direction length of the support pipe 220 can be changed without changing the interval between the first holder 240 and the second holder 250. Thus, interference between the first holder 240 and the second holder 250 can be prevented. Furthermore, the holding pipe 210 can be disposed lower.

What is claimed is:

1. A drum stand, comprising:

a first pipe holding a percussion instrument;

a second pipe to which the first pipe is connected; and a leg member supporting the second pipe on a floor surface, wherein the first pipe is slidable along an axial direction of the second pipe, wherein a lower end of the second pipe is in contact with the floor surface, and wherein the leg member is in contact with the floor surface on one side in a horizontal direction relative to the lower end of the second pipe and supports the second pipe in a state that an upper end of the second pipe is on the one side in the horizontal direction relative to the lower end of the second pipe.

2. The drum stand according to claim 1, further comprising a first holder that connects the first pipe and the second pipe, wherein a mounting position of the first holder on the second pipe is changeable.

3. The drum stand according to claim 1, wherein the second pipe is extensible or retractable along the axial direction of the second pipe.

4. The drum stand according to claim 1, further comprising a second holder that connects the leg member and the second pipe, wherein a mounting position of the second holder on the second pipe is changeable.

5. The drum stand according to claim 4, wherein the leg member comprises a grounding part that is in contact with the floor surface, and a grounding surface of the grounding part that is in contact with the floor surface has a spherical shape.

6. The drum stand according to claim 1, wherein the leg member has a T shape that comprises a first leg part and a second leg part, wherein the first leg part has an end connected with the second pipe and extends toward the one side in the horizontal direction from the second pipe, and the second leg part is connected with the other end of the first leg part and extends in a direction intersecting the first leg part.

7. The drum stand according to claim 6, wherein at least one of the first leg part and the second leg part of the leg member has a curved shape such that the other end of the first leg part or both ends of the second leg part are close to the floor surface.

8. The drum stand according to claim 1, wherein the first pipe is rotatable around the second pipe.

9. The drum stand according to claim 1, wherein the leg member comprises two first leg parts each having an end connected with the second pipe and extending toward the one side in the horizontal direction from the second pipe.

10. The drum stand according to claim 1, wherein the first pipe is made of a curved pipe-shaped member.

11. A drum stand, comprising:

a first pipe holding a percussion instrument;

a second pipe to which the first pipe is connected; and a leg member supporting the second pipe on a floor surface, wherein the second pipe is in contact with the floor surface and tilts relative to the floor surface with an upper end of the second pipe behind a lower end of the second pipe, and wherein the first pipe is slidable along an axial direction of the second pipe.

12. The drum stand according to claim 11, further comprising a first holder that connects the first pipe and the second pipe, wherein a mounting position of the first holder on the second pipe is changeable.

13. The drum stand according to claim 11, wherein the second pipe is extensible or retractable along the axial direction of the second pipe.

14. The drum stand according to claim 11, further comprising a second holder that connects the leg member and the second pipe, wherein a mounting position of the second holder on the second pipe is changeable.

15. The drum stand according to claim 14, wherein the leg member comprises a grounding part that is in contact with the floor surface, and a grounding surface of the grounding part that is in contact with the floor surface has a spherical shape.

16. The drum stand according to claim 11, wherein the leg member has a T shape that comprises a first leg part and a second leg part, wherein the first leg part has an end connected with the second pipe and extends toward one side in a horizontal direction from the second pipe, and the second leg part is connected with the other end of the first leg part and extends in a direction intersecting the first leg part.

17. The drum stand according to claim 16, wherein at least one of the first leg part and the second leg part of the leg member has a curved shape such that the other end of the first leg part or both ends of the second leg part are close to the floor surface.

18. The drum stand according to claim 11, wherein the first pipe is rotatable around the second pipe.

19. The drum stand according to claim 11, wherein the leg member comprises two first leg parts each having an end connected with the second pipe and extending toward one side in a horizontal direction from the second pipe.

20. The drum stand according to claim 11, wherein the first pipe is made of a curved pipe-shaped member.

* * * * *